United States Patent [19]

Schilling

[11] Patent Number: 5,042,562

[45] Date of Patent: Aug. 27, 1991

[54] WEAR RESISTANT MOLD PART FOR THE MANUFACTURE OF MOLDS FOR CASTING PURPOSES

[75] Inventor: Herbert Schilling, Erftstadt, Fed. Rep. of Germany

[73] Assignee: Eisenwerk Brühl GmbH, Brühl, Fed. Rep. of Germany

[21] Appl. No.: 444,125

[22] PCT Filed: Feb. 14, 1989

[86] PCT No.: PCT/EP89/00133

§ 371 Date: Nov. 17, 1989

§ 102(e) Date: Nov. 17, 1989

[87] PCT Pub. No.: WO89/08513

PCT Pub. Date: Sep. 21, 1989

[30] Foreign Application Priority Data

Mar. 18, 1988 [DE] Fed. Rep. of Germany ..... 3809130

[51] Int. Cl.[5] ..... B22C 11/00; B22C 13/12

[52] U.S. Cl. ..... 164/234; 164/232

[58] Field of Search ..... 164/340, 342, 137, 138, 164/344, 228, 234, 232

[56] References Cited

U.S. PATENT DOCUMENTS

| | | | |
|---|---|---|---|
| 2,347,995 | 5/1944 | Dettle | 369/34 |
| 2,510,417 | 6/1950 | Rehklau | 164/228 |
| 2,659,119 | 11/1953 | Peterson | 164/228 |
| 2,800,690 | 7/1957 | Olson | 164/234 |
| 2,807,064 | 9/1957 | Jay | 164/234 |
| 3,103,716 | 9/1963 | Oster | 164/234 |
| 3,830,284 | 8/1974 | Mindock | 164/200 |
| 3,963,209 | 6/1976 | Muller | 164/344 |
| 4,008,748 | 2/1977 | Gunnergaard | 164/340 |
| 4,113,000 | 9/1978 | Poisson . | |

FOREIGN PATENT DOCUMENTS

| | | | |
|---|---|---|---|
| 3620971 | 1/1988 | Fed. Rep. of Germany . | |
| 3720058 | 12/1988 | Fed. Rep. of Germany | 164/234 |
| 2347995 | 11/1977 | France . | |
| 1491604 | 7/1989 | U.S.S.R. | 164/228 |
| 2121709 | 1/1984 | United Kingdom | 164/234 |

OTHER PUBLICATIONS

Martin Engineering Company, *Foundry* Sep. 1951, p. 166.

Fonderie; vol. 122, Mar. 1956, L. Marotine: "Fabrication de Boites . . . ", pp. 98–106.

*Primary Examiner*—Richard K. Seidel
*Assistant Examiner*—Rex E. Pelto
*Attorney, Agent, or Firm*—Spencer & Frank

[57] ABSTRACT

A core box for producing casting cores having a core defining member made of a first material and defining a core molding cavity. A stream of molding substance is introduced into the core molding cavity when a core is molded. A core marker is made of a second material and is located in the core member in fluid communication with the cavity. The second material is more wear-resistant than the first material, being a non-deformable hard metal. The core marker is a shaped insert for defining a predetermined configuration of a casting core when a molding substance is introduced into the core molding cavity. The shaped insert is located at a position within the core molding cavity at which position high velocity flow or changing velocity flow of a stream of molding substance is intercepted.

2 Claims, 2 Drawing Sheets

WEAR RESISTANT MOLD PART FOR THE MANUFACTURE OF MOLDS FOR CASTING PURPOSES

BACKGROUND OF THE INVENTION

The invention relates to a mold part for the manufacture of molds for casting purposes by means of a molding substance, particularly to core boxes for the production of cores for casting purposes, wherein limited surface regions which are exposed to undue wear caused by the stream of the introduced molding substance, preferably surface regions in which the stream of molding substance moves at high velocity or while changing its direction relative to the mold surface and/or along the mold surface.

The term "mold part" in the sense of the invention includes a pattern as well as a core box.

The term "core" in the sense of the present invention includes, on the one hand, members which are placed into a casting mold and solve problems connected with cavities, undercuts and similar problem regions of casting mold design, i.e. casting cores in the conventional sense. On the other hand, the term also includes, in the sense of the present invention, components which can be combined to form a complete casting mold and are manufactured of the same molding substance and according to the same method as casting molds. Depending on the shape of the casting to be produced, the inner wall as well as the outer wall of the casting may be defined by the core members combined into the casting mold. Particularly for the manufacture of complete casting molds composed of several parts made of core sand to which a binder has been added as it is customarily employed as the molding substance for cores, a molding process is advisably employed in which the binder for the core sand is not activated by temperature but by chemical-catalytic processes so that the molding substance hardens in the mold in a short period of time without an increase in temperature and can then be removed from the mold.

While cores in the classical sense, i.e. components produced according to the prior art method, are placed into a sand mold defining the external contour of the casting, "cores" produced according to the above-described method, which, when assembled, constitute the complete casting mold, i.e. the mold defining the interior and exterior contours of the casting, are geometrically very complicated structures which require correspondingly complicated and thus expensive core boxes for their manufacture, particularly since high demands are placed here on the precision of such core boxes. Since the above-described "cold" molding process with chemical-catalytic hardening of the molding substance still in the core box itself requires only a short period of dwell of the molding substance in the core box, a high throughput results which can be even further increased by increasing the fill velocity of the stream of molding material to be introduced into the core box. It has now been found that, with such increases in throughput, the service life of a core box, under consideration of predetermined dimensional tolerances, is noticeably limited. As soon as the tolerance limit is reached, the respective core box must be exchanged and replaced by a new core box, or at least by a reconditioned core box. Due to the complicated geometrical shapes involved, new manufacture as well as reconditioning of such a core box is expensive even if, for that reason, light metal alloys are employed as the material for the core box. The use of a more resistant material for the core box is also not possible for reasons of cost due to the poorer workability of the materials that would be applicable for this purpose.

SUMMARY OF THE INVENTION

It is an object of the invention to configure a mold part of the above defined type, particularly a core box, in such a way that an increase in the service life together with an increase in throughput becomes possible, with the materials employed in the past still being usable.

This is accomplished according to the invention in that the limited surface regions which are subject to wear, particularly surface regions for which high dimensional accuracy is required, are formed by inserts made of a nondeformable material having a great resistance to wear which are inserted into the basic material of the mold part. Although the molding substance, particularly when introduced into the mold cavity, moves along practically the entire surface of the inserted pattern or, in other words, along the inner wall of the core box, and is also subjected to changes in direction, it has been found that even with complicated contours only certain regions of the surface are subjected to noticeable wear. If these regions which, based on experience, can generally be predetermined in connection with prior art mold parts or mold boxes, are now provided with inserts made of a material having a greater resistance to wear, this results in a significant increase in service life. In this connection it has been found that only relatively small surface regions of these critical zones need be "armored", since the noticeable wear observed at the conventional mold parts, particularly at core boxes, occurs only in a narrowly defined region which, however, in the course of use progressively expands due to changes in the "flow path" of the molding substance during its introduction as a result of wear and thus covers larger surface regions. If, however, according to the invention, one provides these critical zones with a material having a greater resistance to wear, the wear of the entire mold surface is surprisingly reduced substantially, particularly since wear due to progressive erosion is prevented in the critical zones. The special advantage is here, in particular, that the prior art materials for the production of such core boxes can be employed and that the wall regions to be produced of a material having a greater resistance to wear cover only very small surface regions compared to the total surface area. Therefore, the costs resulting from the more expensive working of these materials are reduced. Particularly the core surface regions which come in contact with corresponding counterfaces of other cores in order to form a core packet, thus retain their dimensions very accurately over a long service life and thus lead to a noticeable improvement in the quality of the resulting castings. By using inserts, the fact that the surface regions of the mold part endangered by wear are defined by delimited regions and thus in themselves constitute simple mold surfaces is used to advantage. In the manufacture of, for example, a core box, the appropriate recesses can now be worked in these defined surface regions into which a correspondingly shaped insert can then be inserted. Such inserts can be produced with great precision with respect to the mold surface so that the part of the insert constituting the inner wall of the mold can be produced true to dimensions. Thus, a long service life is ensured particularly for such surface regions which extend as projections into the molding substance to be introduced. In a preferred embodiment, the use of hard metal is provided for the inserts. These are hard materials which include at least one hard metal substance, particularly tungsten carbide, titanium carbide or tantalum carbide.

In a preferred embodiment of the invention, it is provided that a core marker, which in the core to be produced appears as a recess, is produced in that the insert is formed of a peg whose free end projects into the mold cavity. Depending on its position in the mold cavity, such a peg is surrounded to a considerable degree by the inflowing molding substance. If now, according to the invention, a peg is employed which has great resistance to wear and exhibits practically no wear at all over the service life under consideration here, it is ensured that the recess formed by the peg in the core to be produced will be very true to dimensions. The peg may here have any desired cross-sectional configuration adapted to the requirements of the core to be produced. In a suitable embodiment of the invention, it is provided that the peg is inserted into a recess of the basic material of the mold part.

In a further preferred embodiment of the invention, it is also provided that, in order to form a core marker which appears as a projection in the core to be produced, the insert introduced into the basic material is composed of a cup-shaped wear resistant material. The deflected and compacting stream of molding substance flowing into this cup is then unable to change dimensions over a long period of operation due to the high wear resistance of the insert material. The consequence is that the projection produced at the resulting core and serving as core marker is also very true to shape. In a core composed of two or more parts, core markers in the form of recesses are provided at the first core part and core markers configured as projections are provided at the subsequent core part so as to engage in the recesses of the first core part when the core parts are assembled. Since these core markers, due to their high accuracy in shape and their high shape retention, retain their predetermined dimensions over a long period of operation, the core parts can be assembled with accurate dimensions so that the castings produced therewith exhibit no mold marks even after long periods of operation of the core molds, thus making it possible to realize high quality castings. The costly removal of casting marks is thus eliminated. With a corresponding conical configuration of mutually associated core markers formed of a projection and a recess, a reliable friction-lock connection of both core parts is possible as well.

In a preferred embodiment of the invention, it is provided that the bottom region of the cup-shaped insert is configured as a gas discharge nozzle which is in communication with the exterior of the mold part by way of at least one discharge channel. This arrangement has the advantage that the gas enclosed in the mold cavity is also able to escape in the region of the cup-shaped inserts, and thus it is ensured that the cup-shaped insert is completely filled with molding substance so that a fault-free core marker is produced.

As a further embodiment of the invention, it is provided that the gas discharge nozzle is formed by a releasable bottom piece equipped with a mushroom shaped head whose upper head face is closed and whose edge extends parallel to and is spaced from the cross-sectional outline of the cup-shaped insert. The space below the head is in communication with the discharge channel. A discharge nozzle of such configuration has a considerable discharge cross section so that only a width of, for example, 0.2 mm need be provided for a gap between the edge of the head and the walls of the cup-shaped insert in order to permit, on the one hand, the passage of the quantities of gas to be discharged in the shortest possible time and, on the other hand, prevent passage of the smallest grain fraction of the molding substance. Even if after a longer period of operation individual molding substance grains should adhere, this would mean only an insignificant reduction in the free passage cross section. Cleaning of such a gas discharge nozzle is simple since it is merely necessary to release the bottom piece and raise it to above the mold surface in order to remove adhering grains of molding substance.

In a particularly advantageous embodiment of the invention, it is provided that the bottom piece is mounted in the mold part so as to be axially displaceable and is connected with a pushing drive. In this arrangement, the bottom piece simultaneously takes over the function of an ejector so that a separate element is no longer required and thus manufacture of the mold is simplified. A further advantage of this embodiment is that the gas discharge nozzles in this region are cleaned with every working stroke. Since the insert connected with the mold part as well as the bottom piece are made of wear resistant material, no disadvantageous influences affect the dimensional stability of the resulting core.

In a preferred embodiment of the invention, it is provided, particularly for a core box, that at least the surface region of the core box disposed opposite the intake channel and its insert are composed of a material having a greater wear resistance than the material of the core box itself. This region of the core box is subjected to the greatest wear since this region is stressed by the entire quantity of molding substance when the latter is shot into the core box and, moreover, the molding substance has the greatest kinetic energy in this region. Due to the fact that the position of the intake channel relative to the interior of the mold can be selected at will, within certain limits, there exists the additional possibility of disposing the intake channel at a location in the core box at which the region of the inner wall of the mold opposite the intake channel has a geometrically simple and thus easily produced surface contour.

The invention will now be described in greater detail with reference to schematic illustrations of embodiments thereof.

DESCRIPTION OF THE PREFERRED EMBODIMENTS

Figure 1:
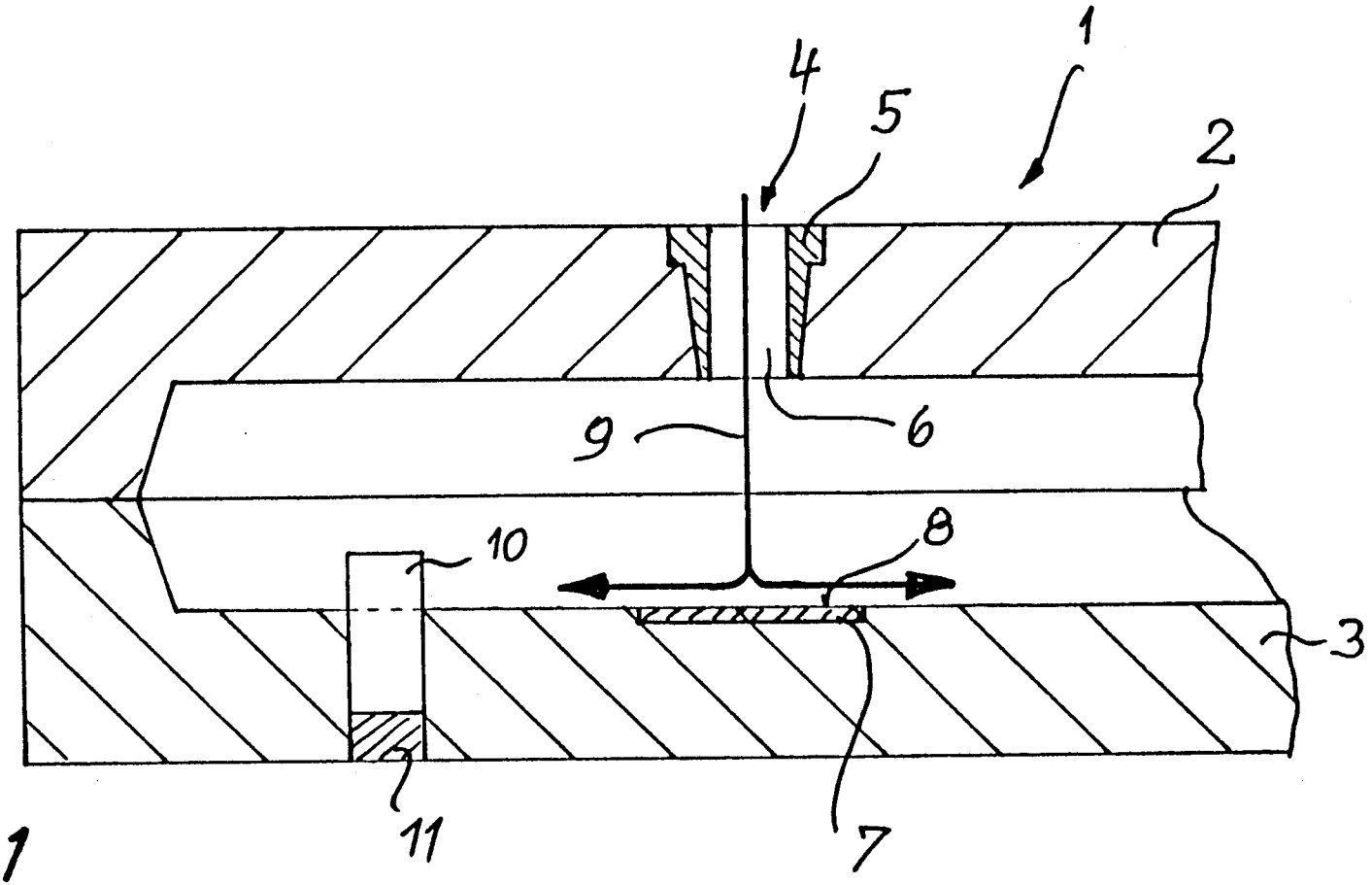
FIG. 1 is a schematic side elevational view of a preferred embodiment of a two-part core box for the production of a core having a recessed core marker.

FIG. 1 is a cross-sectional view of a two-part core box 1 that can be connected with a core molding machine and is composed of an upper box portion 2 and a lower box portion 3 which can be combined by way of centering means (not shown). An intake channel 4 connected with the molding substance supply for the core molding machine is disposed in upper box portion 2. Intake channel 4 is formed by a tubular body 5 of a wear resistant material inserted into the material of upper core box portion 2.

In lower core box portion 3, on the side opposite the opening 6 of intake channel 4, an insert 7 likewise of a wear resistant material is inserted into the wall of the core box, with the surface 8 of insert 7 facing opening 6 corresponding in shape to the shape of the core part to be produced.

Additional inserts in the form of pegs 10 projecting into the mold cavity may be disposed in both box portions, or as shown here schematically only for lower box portion 3, depending on the configuration of the core or casting mold to be produced in order to shape recesses, for example core markers, in the core or casting mold to be produced. Peg 10 is inserted into a recess in the basic material of lower box portion 3 and can be precisely set in its height by way of a back lining 11.

When the core box is charged, the stream of molding substance, here indicated by an arrow 9, enters at high velocity into the interior of the mold and impinges on the surface 8 of insert 7, and is deflected there so that the interior of the mold is continuously filled completely with molding substance. During this process, almost the entire quantity of molding substance filling the interior of the mold impinges on surface 8 of insert 7. The molding substance also flows around pegs 10. Since the danger of wear exists essentially only at pegs 10 and in the region directly opposite opening 6, the surface region of the inner mold wall covered by insert 7 need be only slightly larger than the projection of intake opening 6 on this part of the inner mold wall. In spite of the higher costs for manufacture of a core box of such configuration, it has been found in tests that a service life can be realized which is higher by a multiple compared to the prior art core boxes so that, in the overall calculation, a more cost-effective production results. The gas contained in the interior of the mold is able to escape through gas discharge nozzles (not shown).

In the case of molds or cores which are composed of several parts, one part or one side of the mold is provided with recesses as they are shaped in the molding substance with the aid of pegs 10 illustrated and described in FIG. 1. The other part or the other side of the core must be provided with correspondingly associated peg-shaped projections which appear as recesses in the mold box. Since the flow of molding substance is deflected into such recesses and must be compacted into the recesses but, on the other hand, during unmolding the surface of the peg-shaped projection formed by the recess is moved relative to the developing surface of the recess in the box part, this region is also subjected to great wear.

Figure 2:
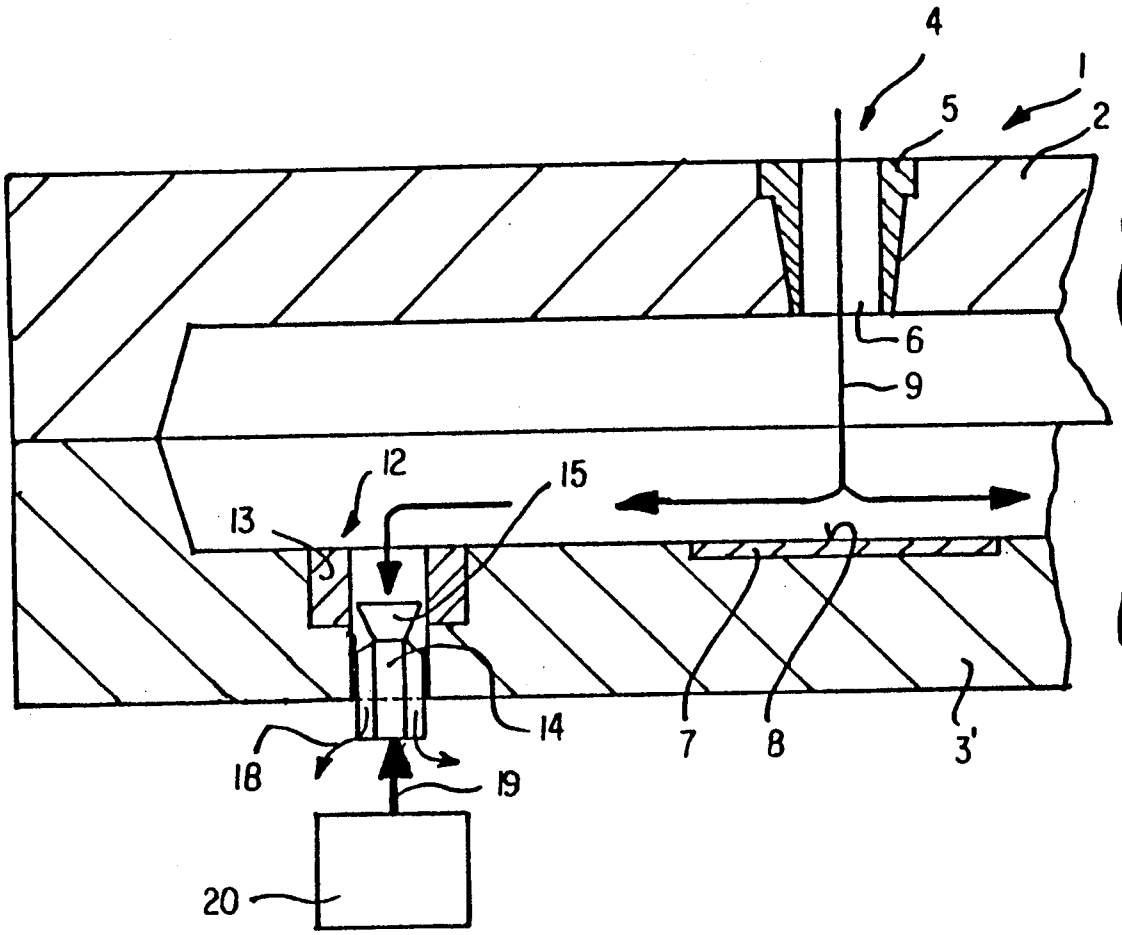
FIG. 2 is a schematic cross-sectional view of a further preferred embodiment of a two-part core box for the production of a core having a peg-shaped core marker.

As shown in FIG. 2, the box parts of this region, here lower box portion 3', are provided with a cup-shaped insert 12 of a wear resistant material so that here again true dimensions of the peg-shaped projection to be molded on are ensured over longer periods of operation. Since the recess to be shaped by means of the mold box of FIG. 1 as well as the peg-shaped projection to be shaped on by means of the mold box according to FIG. 2 retain their dimensions even after long production runs, the two core or mold sections to be produced can be assembled true to dimension and without play so that no offset exists in the dividing plane between the two core or mold parts. The castings produced thereby thus have practically no mold marks.

The cup-shaped insert 12 of FIG. 2 now has such a configuration that it simultaneously constitutes a gas discharge nozzle. Accordingly, insert 12 is divided into a tubular wall portion 13 and a releasable bottom piece 14 which has a mushroom shaped head 15. The tubular wall portion 13 has a mold cross section which need not be circular but is shaped as desired depending on the requirements for the core to be produced and for the associated core marker of the other section. The outer contour of mushroom shaped head 15 is dimensioned accordingly, with the edge 16 of head 15 facing the inner wall of tubular portion 13 extending parallel and at a slight distance from inner wall 17. The width of the thus formed gap is, for example, only 0.2 mm.

The area below the mushroom shaped head is in communication with a gas outlet 18 so that during intake of the molding substance the gas from the interior of the mold is able to also escape through the cup-shaped inserts 12 forming the gas discharge nozzles. In this way it is ensured that the cup-shaped projections to be shaped to the core or mold part being produced are fully shaped and completely compacted.

Since generally such mold parts have a large number of gas discharge nozzles and also a large number of core markers, the above described shape of the gas discharge nozzles offers the additional opportunity of using them simultaneously as ejectors. For this purpose, a shaft 19 connected with bottom piece 14 is connected with a drive 20. After opening of the core box, the bottom pieces are moved by means of drive 20 in the direction toward the interior of the mold and thus the finished core is released from the mold and can then be removed.

The use of bottom piece 14 of the cup-shaped inserts 12 as ejector is not limited to the illustrated embodiment. The particular structural configuration of these discharge nozzles is composed of a tubular part of a wear resistant material and a bottom piece likewise composed of wear resistant material. This makes it possible to also use such gas discharge nozzles as ejectors in which the head face of the bottom piece lies in a plane with the adjacent faces of the inner mold wall. This has the advantage that the ejection process causes the gas discharge nozzle to clean itself but, on the other hand, the use of wear resistant materials also ensures that grains of molding substance wedged in the gap between head piece and insert wall are practically unable to contribute to wear and thus to a widening of the gas discharge gap.

Figure 3:
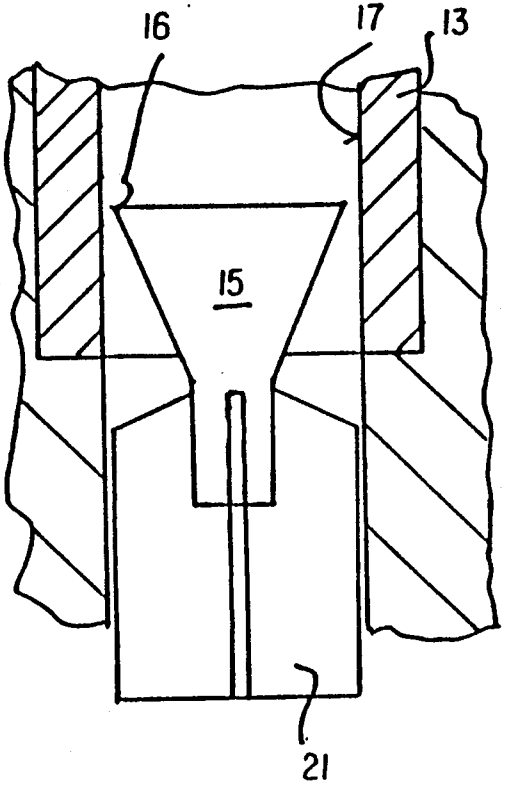
FIG. 3 is a schematic side elevational view, to a larger scale, of an insert configured as a combination of gas outlet and core ejector.

FIG. 3 shows, to a larger scale, the configuration of such a gas discharge nozzle operated as ejector. As can be seen in FIG. 3, the shaft 19 attached to head 15 has the shape of a stem and is provided with three or four wing-like attachments 21 by means of which the bottom piece is guided in a centering manner so that a constant gap width between edge 16 and inner wall 17 is ensured.

Due to the required greater precision, inserts 5, 7, 10, 12 and also intake channel 4 are produced of a nondeformable, wear resistant material. Preferably, hard metals are employed for this purpose. Their composition also depends on the wear stresses. For example, intake channel 4 is subject to the greatest stresses.

I claim:

1. A core box for producing casting cores, comprising:

a core means for defining a core molding cavity, said core means comprising a first material; and a core marker means in said core means and being in fluid communication with said cavity, said core marker means comprising a second material having a greater wear-resistance than said first material, said second material being a nondeformable hard metal, said core marker means comprising at least one shaped insert for defining a predetermined configuration of a casting core when a molding substance is introduced into said core molding cavity, and one of said at least one shaped inserts being an intake channel for introducing a stream of molding substance into said core molding cavity, and said at least one shaped insert being located at a position in said core means and within said core molding cavity at which position high velocity flow or changing velocity flow of a stream of molding substance is intercepted and said shaped insert comprises a tube-like insert having a first end communicating with said mold cavity and configured for defining a projection on a casting core, and said tube-like insert having a second end, a gas discharge channel defined in said core means and fluidly communicating with the exterior of said core means and fluidly communicating with said second end, and a gas nozzle disposed in said tube-like insert and in said gas discharge channel, said gas nozzle includes a releasable lower piece having a mushroom-shaped head, an upper face is disposed on said mushroom-shaped head and faces said core molding cavity, and said upper face is closed and is disposed within said tube-like insert, and said releasable lower piece is disposed in said gas discharge channel.

2. A core box as defined in claim 1, wherein said releasable lower piece is axially displaceably mounted and is in communication with a pushing drive.

* * * * *